US012698946B2

(12) United States Patent
Ross et al.

(10) Patent No.: US 12,698,946 B2
(45) Date of Patent: Aug. 4, 2026

(54) ADJUSTABLE FIREARM STOCK WITH PASSIVE TENSIONING MECHANISM

(71) Applicant: Magpul Industries Corp., Austin, TX (US)

(72) Inventors: Robert Allan Ross, Golden, CO (US); Timothy Eric Roberts, Broomfield, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 19/159,678

(22) PCT Filed: Mar. 28, 2024

(86) PCT No.: PCT/US2024/021856
§ 371 (c)(1),
(2) Date: Aug. 26, 2025

(87) PCT Pub. No.: WO2024/206558
PCT Pub. Date: Oct. 3, 2024

(65) Prior Publication Data

US 2026/0110515 A1 Apr. 23, 2026

Related U.S. Application Data

(60) Provisional application No. 63/455,279, filed on Mar. 29, 2023.

(51) Int. Cl.
*F41C 23/14* (2006.01)
*F41C 23/04* (2006.01)

(52) U.S. Cl.
CPC ..... *F41C 23/14* (2013.01); *F41C 23/04* (2013.01)

(58) Field of Classification Search
CPC ..... F41C 23/04; F41C 23/14
(Continued)

(56) References Cited

U.S. PATENT DOCUMENTS 7,162,822 B1 1/2007 Heayn et al.
7,762,018 B1 7/2010 Fitzpatrick et al.
(Continued)

FOREIGN PATENT DOCUMENTS

CN 302064841 9/2012
CN 305173927 5/2019
(Continued)

OTHER PUBLICATIONS

CTR® Carbine Stock—Mil-Spec, Magpul, 6 pages, online available at <https://magpul.com/ctr-carbine-stock-mil-Spec.html>, retrieved on: Jun. 22, 2023.
(Continued)

*Primary Examiner* — John Cooper
(74) *Attorney, Agent, or Firm* — NOD Law PC

(57) ABSTRACT

Embodiments of the disclosure relate to adjustable stocks for firearms and methods for installing an independently sprung tensioning mechanism. The adjustable stock comprises a stock body attached to a buffer tube, with a lever-operated tensioning mechanism. The mechanism includes a tensioning block with fins to grip the buffer tube, an indexing pin, and a retaining pin. When the lever is depressed, the tensioning block and indexing pin disengage, allowing longitudinal adjustment of the stock on the buffer tube. The tensioning block applies upward pressure on the tube, compensating for rotational tolerances during assembly. Both the tensioning block and indexing pin move independently when engaging with the buffer tube but move together when disengaging. The indexing pin is biased towards the buffer tube by a spring, while another spring biases the tensioning
(Continued)

block. The lever engages the retaining pin to retract both the indexing pin and tensioning block.

11 Claims, 14 Drawing Sheets

(58) Field of Classification Search
USPC ..... 42/71.01
See application file for complete search history.

(56) References Cited

U.S. PATENT DOCUMENTS

| | | | | |
|---|---|---|---|---|
| 7,823,313 | B2 | 11/2010 | Faifer | |
| 7,849,626 | B2 | 12/2010 | Fluhr | |
| D640,342 | S | 6/2011 | Fitzpatrick et al. | |
| 7,966,761 | B1 | 6/2011 | Kuczynko et al. | |
| 8,087,193 | B2 * | 1/2012 | Kincel | F41C 23/14 42/74 |
| 8,127,483 | B2 | 3/2012 | Kincel | |
| D661,366 | S | 6/2012 | Zusman | |
| D668,311 | S | 10/2012 | Rogers et al. | |
| 8,327,559 | B2 | 12/2012 | Berger et al. | |
| 8,327,569 | B2 | 12/2012 | Kincel | |
| 8,341,868 | B2 * | 1/2013 | Zusman | F41C 23/22 42/74 |
| 8,342,075 | B2 | 1/2013 | Gomez | |
| D704,294 | S | 5/2014 | Jarboe | |
| 8,806,791 | B2 | 8/2014 | Cottle | |
| D722,357 | S | 2/2015 | Keller et al. | |
| D722,669 | S | 2/2015 | Keller | |
| 8,950,099 | B2 | 2/2015 | Rogers et al. | |
| 8,978,284 | B1 | 3/2015 | Zusman | |
| 8,978,285 | B1 * | 3/2015 | Burke | F41C 23/04 42/74 |
| D728,057 | S | 4/2015 | Daniel et al. | |
| 9,109,855 | B1 * | 8/2015 | Kincel | F41C 23/20 |
| D738,981 | S | 9/2015 | Zusman | |
| D745,622 | S | 12/2015 | Zusman | |
| D747,427 | S | 1/2016 | Zusman | |
| 9,261,324 | B1 | 2/2016 | Liang et al. | |
| D760,326 | S | 6/2016 | Chu | |
| 9,546,836 | B2 | 1/2017 | Cottle et al. | |
| 9,551,549 | B1 * | 1/2017 | Chvala | F41C 7/00 |
| 9,612,083 | B2 | 4/2017 | Cottle et al. | |
| D792,937 | S | 7/2017 | Eitan et al. | |
| 9,746,281 | B2 | 8/2017 | Wilson et al. | |
| 9,791,238 | B2 | 10/2017 | Bowen | |
| D804,602 | S | 12/2017 | Barfoot et al. | |
| D831,149 | S | 10/2018 | Barfoot et al. | |
| 10,139,195 | B2 | 11/2018 | Olsen | |
| 10,156,421 | B2 | 12/2018 | Smith et al. | |
| D840,493 | S | 2/2019 | Bowman et al. | |
| 10,260,837 | B1 | 4/2019 | McGinty | |
| 10,527,385 | B1 | 1/2020 | Schumacher | |
| 10,830,558 | B2 | 11/2020 | Underwood et al. | |
| 11,435,158 | B1 * | 9/2022 | Liao | F41C 23/14 |
| 11,592,263 | B2 | 2/2023 | Vanek | |
| 11,609,065 | B2 | 3/2023 | Raymond | |
| 11,892,268 | B1 | 2/2024 | Coombs et al. | |
| D1,034,881 | S | 7/2024 | Aguilar et al. | |
| D1,078,911 | S | 6/2025 | Ross et al. | |
| 2007/0261284 | A1 | 11/2007 | Keng | |
| 2007/0289190 | A1 | 12/2007 | Oz | |
| 2010/0242333 | A1 * | 9/2010 | Kincel | F41C 23/14 42/73 |
| 2010/0242334 | A1 * | 9/2010 | Kincel | F41C 23/14 42/74 |
| 2013/0097911 | A1 | 4/2013 | Lame | |
| 2013/0180148 | A1 * | 7/2013 | Rogers | F41C 23/04 42/73 |
| 2015/0052795 | A1 * | 2/2015 | Burke | F41C 23/04 42/71.01 |
| 2015/0345881 | A1 | 12/2015 | Irvin | |
| 2016/0178314 | A1 | 6/2016 | Kielsmeier et al. | |
| 2016/0187099 | A1 | 6/2016 | Cottle et al. | |
| 2017/0122698 | A1 | 5/2017 | Chu | |
| 2019/0017774 | A1 * | 1/2019 | Vanek | F41C 23/04 |
| 2019/0049213 | A1 * | 2/2019 | Yang | F41C 23/14 |
| 2020/0182586 | A1 * | 6/2020 | Zhang | F41C 23/20 |
| 2020/0400403 | A1 | 12/2020 | Vanek | |
| 2021/0239423 | A1 * | 8/2021 | Liptak | F41C 23/14 |
| 2021/0254928 | A1 * | 8/2021 | Raymond | F41C 23/14 |
| 2021/0381799 | A1 * | 12/2021 | Alomaira | F41C 23/14 |
| 2025/0093127 | A1 * | 3/2025 | Palmer | F41C 23/04 |

FOREIGN PATENT DOCUMENTS

| | | |
|---|---|---|
| JP | D1470964 | 6/2013 |
| JP | D1789378 | 1/2025 |
| TW | D173531 | 2/2016 |
| TW | D181991 | 3/2017 |
| TW | M637325 U | 2/2023 |

OTHER PUBLICATIONS

MOE® Carbine Stock—Mil-Spec, Magpul, 7 pages, online available at: <https://magpul.com/moe-carbine-stock-mil-spec.html>, retrieved on: Jun. 22, 2023.

Moe® SL-S™ Carbine Stock—Mil-Spec, Magpul, 7 pages, online available at: <https://magpul.com/moe-sl-k-stock-mil-spec.html>, retrieved on: Jun. 22, 2023.

BCM® Stock-Mod 0-Black, Bravo Company USA, 2 pages, Available online at: https://bravocompanyusa.com/bcmgunfighter-stock-mod-0-black/>, retrived on: Jun. 23, 2023.

Enhanced Sopmod Stock, B5 Systems, 7 pages, online available at: <https://b5systems.com/enhanced-sopmod-stock/>, retrieved on: Jun. 22, 2023.

MOE® SL-KR Carbine Stock—Mil-Spec, Magpul, 6 pages, online available at: <https://magpul.com/moe-sl-s-carbine-stock-mil-spec.html>, retrieved on: Jun. 22, 2023.

AEBK-A5: VLTOR A5 Stock Combo Kit, VLTOR Weapon Systems, 3 pages, online available at: <https://www.vltor.com/shop/ar/stocks/aebk-a5-vltor-a5-stock-combo-kit/>, retrieved on: Jun. 22, 2023.

UBR® GEN2 Collapsible Stock, Magpul, 7 pages, online available at: <https://magpul.com/ubr-gen2-collapsible-stock.html?mp_global_color=118>, known as early as Oct. 27, 2023.

International Preliminary Report on Patentability received for PCT Application No. PCT/US2024/021856, dated Oct. 9, 2025, 9 pages.

Sopmod Buttstock, Black, R-L7LA2BA, LMT Defense, 2 pages, online available at <https://lmtdefense.com/product/sopmod-buttstock-black/>, retrieved on: Jun. 22, 2023.

Restriction Requirement received for U.S. Appl. No. 29/888,204 dated Nov. 4, 2024, 6 pages.

Notice of Allowance received for U.S. Appl. No. 29/888,204 dated Feb. 12, 2025, 6 pages.

BATTLELINK Extreme Duty Minimalist Stock, Mission First Tactical, 2 pages, online available at: < https://missionfirsttactical.com/battlelink-extreme-duty-minimalist-stock/>, known as early as Aug. 18, 2023.

BATTLELINK Minimalist Milspec Stock, Mission First Tactical, 2 pages, online available at: <https://missionfirsttactical.com/BMSMIL>, known as early as Aug. 18, 2023.

BCM® Stocks, Bravo Company USA, 2 pages, online available at: <https://bravocompanyusa.com/bcm-stocks/>, known as early as Aug. 18, 2023.

Bravo Stock, B5 Systems, 1 page, online available at: <https://b5systems.com/bravo-stock/>, known as early as Aug. 18, 2023.

Knoxx Axiom Adjustable Buttstock, Blackhawk, 2 pages, online available at: <https://www.blackhawk.com/accessories/stocks/knoxx-axiom-adjustable-buttstock/1000915.html>, known as early as Aug. 18, 2023.

LaRue Tactical RAT Stock, LaRue Tactical, 1 page, online available at: <https://www.larue.com/products/larue-tactical-rat-stock/>, known as early as Jul. 13, 2023.

(56) References Cited

OTHER PUBLICATIONS

LCS Carbon Fiber Stock, Lancer Advanced Weapons and Components, 1 page, online available at: < https://lancer-systems.com/product/lcs-carbon-fiber-stock>, known as early as Aug. 18, 2023.
MBA-2 Rifle Buttstock, Luth-ar, 3 pages, online available at: <https://luth-ar.com/product/mba-2-rifle-buttstock/>, known as early as Aug. 18, 2023.
MBA-4 Carbine Buttstock, Luth-ar, 3 pages, online available at: <https://luth-ar.com/product-category/buttstocks/ mba-4/>, known as early as Aug. 18, 2023.
MBA-5 Carbine Buttstock, Luth-ar, 3 pages, online available at: <https://luth-ar.com/product/mba-5-buttstock/>, known as early as Aug. 18, 2023.
PRS® Lite Stock, Magpul, 2 pages, online available at <https://magpul.com/prs-lite-stock.html?mp_global_color=118>, known as early as Aug. 18, 2023.
RECC•E™ Carbine Stock for SR-15/M4/AR-15, Reptilia, 2 pages, online available at <https://reptiliacorp.com/product/ar15-m4-m16-recce-carbine-stock/>, known as early as Aug. 18, 2023.
RECC•E™ Carbine Stock for SR-25/A5/AR-10, Reptilia, 1 page, online available at <https://reptiliacorp.com/product/recce-sr25-a5-ar10-stock/>, known as early as Aug. 18, 2023.
Shot Show 2022—Geissele, Brownells, Inc., Youtube, 2 pages, online available at <https://youtube/tDL0ObYijPw?t=66>, known as early as Oct. 27, 2023.
Taskernetwork, Instagram, 1 page, online available at <https://magpul.com/ubr-gen2-collapsible-stock.html?mp_global_color=118>, known as early as Oct. 27, 2023.
The Geissele GFR 6mm ARC RECCE Rifle, TFBTV Show Time, Youtube, 2 pages, online available at <https://youtube/Bex0jT-vJhQ?t=436>, known as early as Oct. 27, 2023.
ZHUKOV-S® Stock—Yugo, Magpul, 2 pages, online available at <https://magpul.com/zhukov-s-stock-yugo-m70.html>, known as early as Aug. 18, 2023.
ZHUKOV-S® Stock, Magpul, 2 pages, online available at <https://magpul.com/zhukov-sfoldingstock-ak47-ak74.html>, known as early as Aug. 18, 2023.
Taiwan Patent Application No. 113301696, Office Action of the Intellectual Property Office dated Sep. 24, 2024, 3 pages.
Notice of Allowance with Search Report of Taiwan Application No. 113306752 dated May 13, 2025, 8 pages.
Notice of Allowance with Search Report of Taiwan Application No. 113306753 dated May 13, 2025, 8 pages.
Ex Parte Quayle Action received for U.S. Appl. No. 29/940,947 dated May 27, 2025, 7 pages.
F3 Tactical, Inc., Sep. 5, 2018, facebook.com, site visited May 17, 2025, 1 page, URL: https://www.facebook.com/F3Tactical/photos/t.100064755370712/1363452530425000/?type=3 (Year: 2018).
Magpul, Jan. 16, 2024, x.com, site visited May 17, 2025, 1 page, URL: https://x.com/Magpul/status/1747344260586692626 (Year: 2024).
Patrick McCarthy, New Magpul DT "Dual Tension" Carbine Stock | RECOIL, 3 pages, Jan. 2, 2024, recoilweb.com, site visited May 17, 2025, URL: https://www.recoilweb.com/magpul-dt-dual-tension-carbine-stock-review-i 83017.html (Year: 2024).
Notice of Allowance received for U.S. Appl. No. 29/940,947 dated Aug. 12, 2025, 6 pages.
International Patent Application No. PCT/US24/21856, filed Mar. 28, 2024. International Search Report dated Aug. 30, 2024. 4 pages.
International Patent Application No. PCT/US24/21856, filed Mar. 28, 2024. Written Opinion of the International Searching Authority dated Aug. 30, 2024. 7 pages.
TW Office received for Taiwanese Patent Application No. 113112164, mailed on Feb. 10, 2025, 5 pages (1 page of English Translation and 4 pages of Original Document).
Extended European Search Report and Search Opinion received for European Application No. 24781888.3, mailed on Mar. 3, 2026, 7 pages.

* cited by examiner

ADJUSTABLE FIREARM STOCK WITH PASSIVE TENSIONING MECHANISM

CLAIM OF PRIORITY UNDER 35 U.S.C. § 119

The present application for patent is the United States national phase of International PCT Patent Application No. PCT/US24/21856, entitled "ADJUSTABLE FIREARM STOCK WITH PASSIVE TENSIONING MECHANISM" filed Mar. 28, 2024, which claims priority to and the benefit of U.S. Provisional Application No. 63/455,279, entitled "ADJUSTABLE FIREARM STOCK WITH PASSIVE TENSIONING MECHANISM" filed Mar. 29, 2023. Both aforementioned applications are hereby incorporated by reference herein in their entirety.

FIELD OF THE DISCLOSURE

The present disclosure relates generally to adjustable firearm stocks. In particular, but not by way of limitation, the present disclosure relates to systems, methods and apparatuses for a mechanism on an adjustable stock that has the dual purpose of tension and retention.

DESCRIPTION OF RELATED ART

Collapsible carbine stocks historically have wobble or slop when installed on a receiver extension or buffer tube due to tolerance discrepancies between mating components which can affect stability and accuracy of the weapon.

MAGPUL Corporation has developed a CTR Stock to overcome this issue, but in mitigating wobble with a separate friction lock, the CTR also adds a separate user action for adjusting and reengaging the friction lock. In some cases, users neglect to reengage the friction lock. Further, even when properly engaged, the friction lock can pop out of position due to impact or firing. Thus, reduced wobble comes at the cost of degraded user experience and reliability.

MAGPUL's SL-K attempts to address the issue of wobble by using the lock pin spring to bias the lever arm through an opening in the stock exterior to press against the receiver extension. While this approach can reduce lateral and vertical play, the system is not optimized for limiting some types of rotational movement. Additional clamping pressure can improve the fit but is at the expense of ease of adjustment.

MAGPUL also provides its MOE SL product with yet another approach to reducing tolerance discrepancies: one or more internal leaf springs maintain contact and thus tension with the buffer tube throughout the stock's sliding adjustments on the buffer tube. The leaf springs also make adjustments more difficult because the constant drag during fore-aft movement can retain the stock in between lock positions. Care in adjustment technique must be used to ensure the lock mechanism is properly seated. In addition, the leaf springs require special materials and coatings to avoid marring the buffer tube finish.

SUMMARY OF THE DISCLOSURE

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

Some embodiments of the disclosure may be characterized as an adjustable stock comprising: a stock body configured to couple to a buffer tube of a firearm; a lever; and an independently sprung tensioning mechanism comprising: a tensioning block having an aperture; an indexing pin slidingly arranged through the aperture in the tensioning block and independently sprung from the tensioning block; and a retaining pin passing through both the tensioning block and the indexing pin such that when depressed by the lever, both the tensioning block and the indexing pin are disengaged from the buffer tube allowing the stock body to be longitudinally adjusted on the buffer tube. In some embodiments, the adjustable stock further comprises two fins extending from a top thereof configured to surround a keyed extension of the buffer tube and wedge between sides of the keyed extension and insides of the stock body when in an engaged position, and the tensioning block is configured to wedge itself between walls of the stock body and the keyed extension to apply pressure onto the buffer tube and take up rotational tolerances in assembly. In some embodiments, the tensioning block has a U-shaped profile and is configured to exert upward pressure on the buffer tube. In many embodiments, the indexing pin is biased toward the buffer tube. In some embodiment, the adjustable stock further comprises a first spring biasing the indexing pin toward the buffer tube and a second spring biasing the tensioning block toward the buffer tube, and the first spring is arranged inside the indexing pin and the second spring is arranged outside the indexing pin. In some embodiments, the tensioning block and the indexing pin move independently along an axis. In some embodiments, the tensioning block and the indexing pin move independently when engaging with the buffer tube but move in concert when disengaging from the buffer tube.

Other embodiments of the invention include an adjustable stock assembly for a firearm, comprising: a stock body configured to couple to a buffer tube of the firearm; an independently sprung tensioning mechanism within the stock body, comprising: a tensioning body configured to couple to the stock body; an indexing pin slidably arranged within an aperture in the tensioning body and having a first spring coupled within a hollow of the indexing pin; a first retaining pin coupled through a first set of apertures in the indexing pin and coupled through two additional apertures within the tensioning body, and wherein a first end of the first spring abuts to a bottom portion of the first retaining pin; a second retaining pin coupled through a second set of apertures in the indexing pin, wherein a second end of the first spring abuts to a top portion of the second retaining pin; and a second spring coupled around the indexing pin between the first and second retaining pins. In some embodiments, the tensioning body has two fins extending from a top side of the tensioning body, thereby providing a u-shaped profile to the tensioning body and the two tensioning fins form a friction fit engagement with a keyed extension of the buffer tube. In some embodiments, the two fins of the tensioning body are tapered. In some embodiments, the first retaining pin is actuated by a lever to retract the indexing pin from engagement with the buffer tube. In other embodiments the adjustable stock assembly comprises one or more stops within the buffer tube limiting movement of the indexing pin. In some embodiments, the tensioning body and the indexing pin can move independently to accommodate tolerance differences between the stock body and the buffer tube.

In other embodiments of the present invention, a method for installing an independently sprung tensioning mechanism in an adjustable stock assembly is provided, comprising: inserting an indexing pin through an aperture in a tensioning body; aligning a first pair of apertures in the indexing pin with a pair of apertures in the tensioning body; inserting a first retaining pin through the aligned pair of apertures; sliding a first spring onto the indexing pin, wherein a first end of the first spring abuts against the first retaining pin; inserting a second spring into a hollow in the tensioning body around a portion of the indexing pin; and compressing both springs to allow insertion of a second retaining pin through a second pair of apertures in the indexing pin. In some embodiments, the method further comprises coupling a first end of a lever between the first retaining pin a keyed extension of a buffer tube by a friction fit. In some embodiments, the method further comprises coupling the tensioning body to a keyed extension of a buffer tube. In many embodiments, the method further comprises securing a cap to a bottom of an angled portion of a stock body to cover the independently sprung tensioning mechanism.

BRIEF DESCRIPTION OF THE DRAWINGS

Various objects and advantages and a more complete understanding of the present disclosure are apparent and more readily appreciated by referring to the following detailed description and to the appended claims when taken in conjunction with the accompanying drawings:

DETAILED DESCRIPTION

Figure 1:
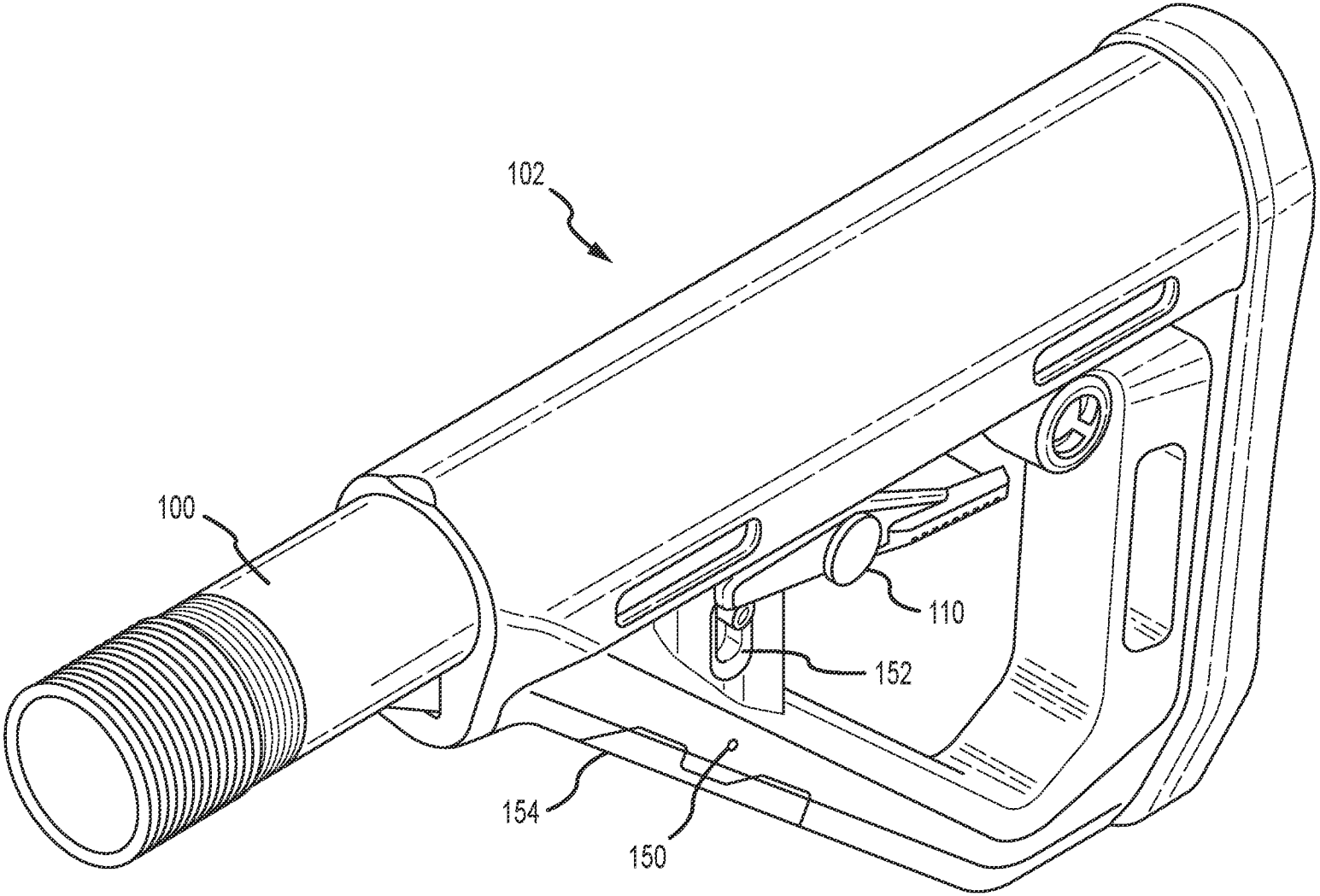
FIG. 1 is a perspective view of an adjustable stock in accordance with an embodiment of the present invention.

Adjustable stock assemblies typically allow for changes in length of pull (the distance from the trigger to the rear of the stock) and sometimes other adjustments such as cheek height or angle. These adjustments can accommodate shooters of different sizes, body types, and shooting styles, enhancing comfort, stability, and accuracy. There is a need for an adjustable stock and/or adjustable stock assembly that can account for tolerance differences between fitments, thereby providing a user with less wobble than known collapsible stocks, and yet allowing ease of user adjustment and without a risk of scratching the buffer tube. Accordingly, the present disclosure generally relates to an adjustable stock and/or adjustable stock assembly for selectable attachment to a firearm buffer tube (e.g., that of an M4 Carbine) using a self-adjusting, independently sprung, tensioning mechanism that works in conjunction with a stock's indexing pin and adjustment lever to maintain and adjust a stock-to-buffer tube coupling with minimal free play. Via independent bias, a tensioning block and the indexing pin are able to engage with the inside and outside of the buffer tube keyway or keyed extension thereby compensating for tolerance differences between different buffer tubes.

The word "exemplary" is used herein to mean "serving as an example, instance, or illustration." Any embodiment described herein as "exemplary" is not necessarily to be construed as preferred or advantageous over other embodiments.

Preliminary note: the flowcharts and block diagrams in the following Figures illustrate the functionality and operation of possible implementations of a selector lever according to various embodiments of the present disclosure. It should be noted that, in some alternative implementations, the functions noted in each block may occur out of the order noted in the figures. For example, two blocks shown in succession may, in fact, be executed substantially concurrently, or the blocks may sometimes be executed in the reverse order, depending upon the functionality involved.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure.

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items and may be abbreviated as "/".

It will be understood that when an element or layer is referred to as being "on," "connected to," "coupled to," or "adjacent to" another element or layer, it can be directly on, connected, coupled, or adjacent to the other element or layer, or intervening elements or layers may be present. In contrast, when an element is referred to as being "directly on," "directly connected to," "directly coupled to," or "immediately adjacent to" another element or layer, there are no intervening elements or layers present.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing. Accordingly, the regions illustrated in the figures are schematic in nature and their shapes are not intended to illustrate the actual shape of a region of a device and are not intended to limit the scope of the disclosure.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

Figure 13:
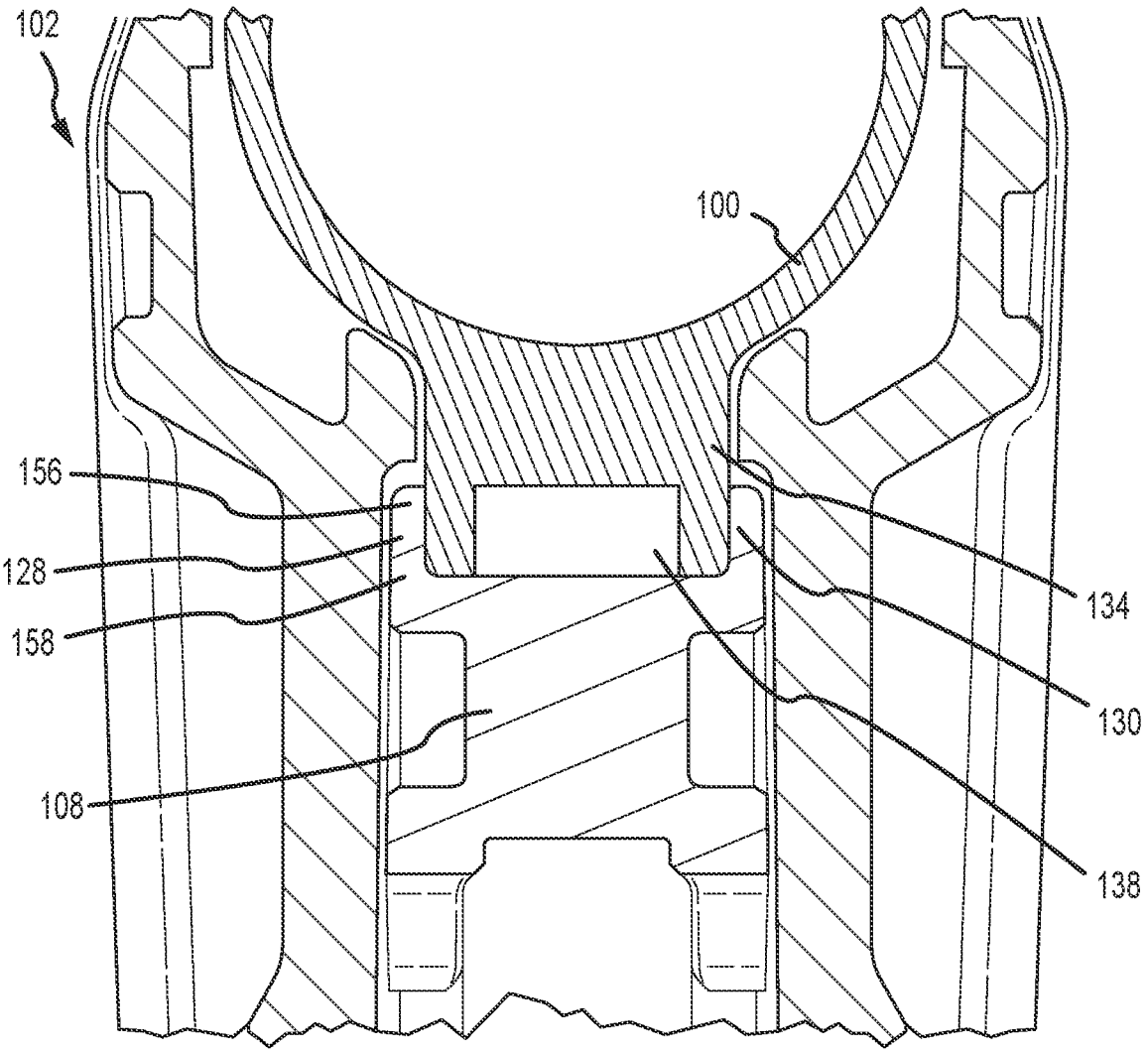
FIG. 13 is a close-up view of a portion of an adjustable stock in accordance with an embodiment of the present invention.

For the purposes of this disclosure, a tensioner block is a tensioning mechanism that is independently sprung from and works in conjunction with the indexing pin of an adjustable stock to maintain consistent pressure on a surface of the buffer tube (e.g., the buffer tube keyway). This mechanism can also be referred to as the independently sprung tensioning mechanism. The tensioner block may have a u-shaped profile when viewed along a longitudinal axis of the firearm or buffer tube, and this u-shaped profile acts as a wedge (and may even have a wedge shape as seen in FIG. 13) when engaged with the buffer tube and stock, thereby decreasing wobble or tolerance discrepancies between the stock and the buffer tube. This improves not only perception of quality but aids accuracy since stable contact with the shoulder and cheek are crucial to providing overall weapon stability. Additionally, the tensioner block can wedge itself further into engagement under vibration, recoil, or other shifting caused by interface with the user, as opposed to backing itself out of engagement in these circumstances. Two independent compression springs are implemented to independently bias the indexing pin into the buffer tube keyway and the tensioner block around the buffer tube keyway (and also wedged between the buffer tube keyway and an inside of the stock). Yet, retraction of the indexing pin also retracts the tensioner block so that a change in indexed position or length of pull of the stock is more easily achieved than prior art systems where secondary tension is non-removable.

Figure 9:
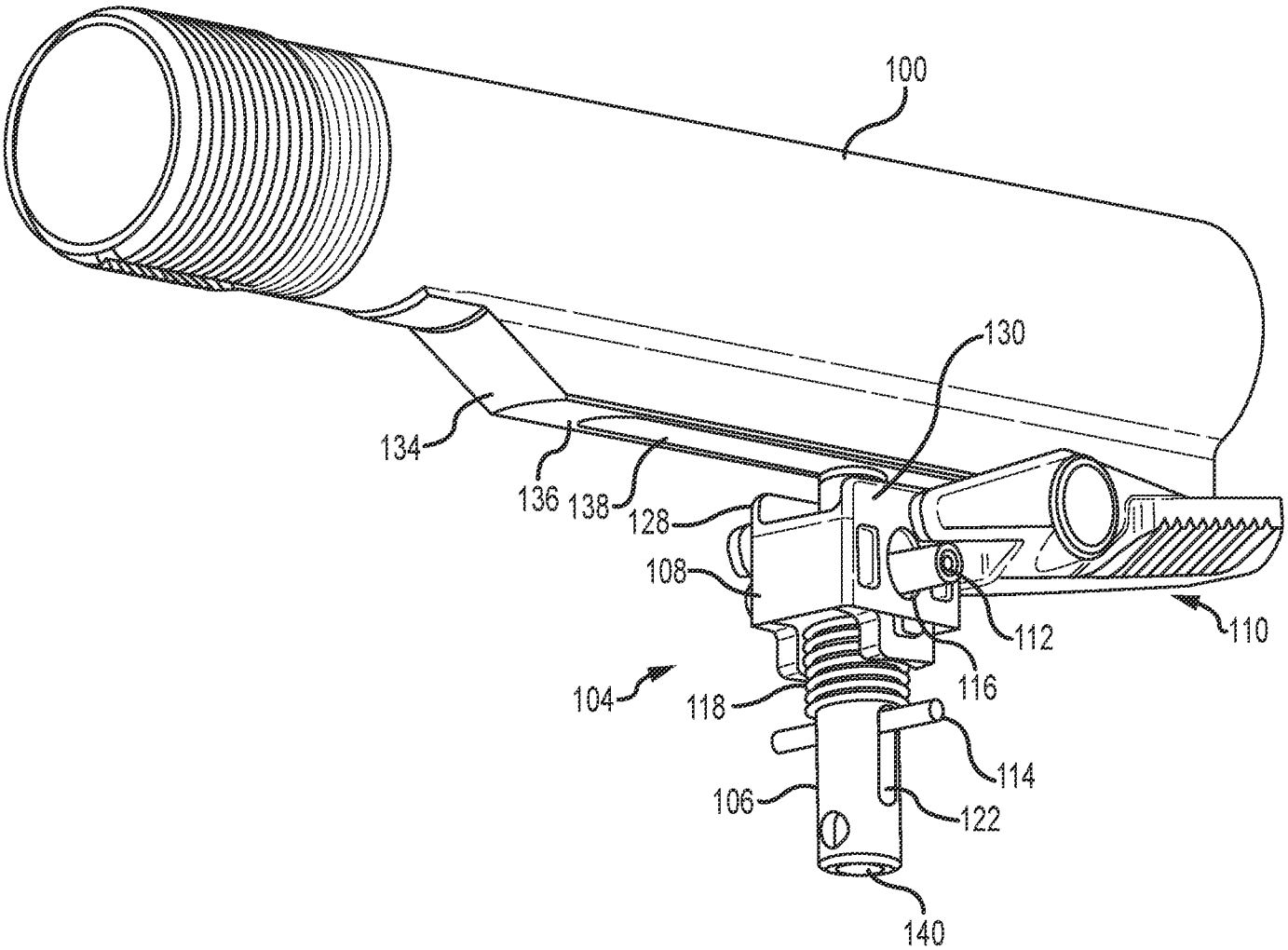
FIG. 9 is a perspective view of an adjustable stock with the stock body removed from view in accordance with an embodiment of the present invention.
Figure 10:
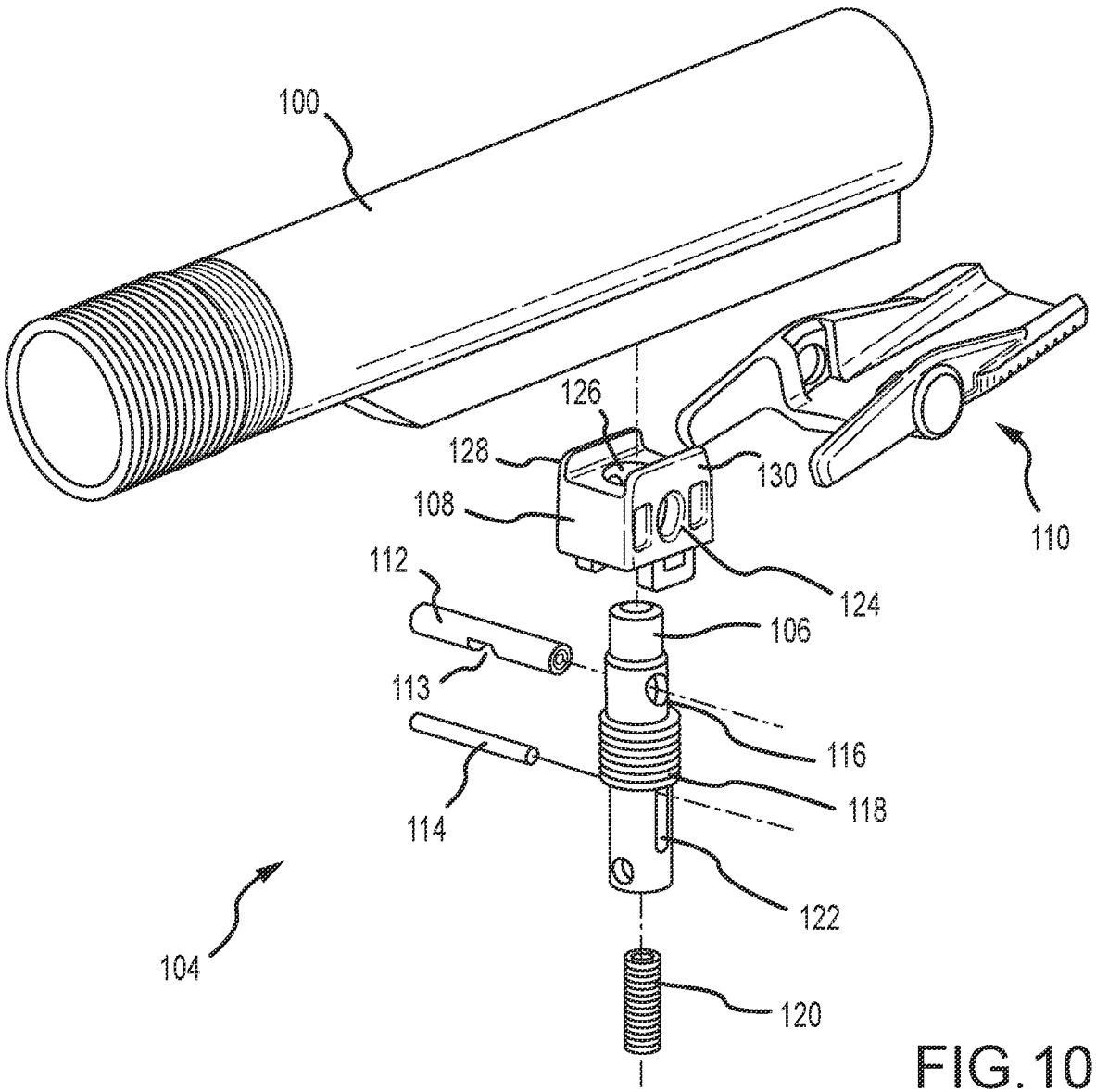
FIG. 10 is a perspective exploded view of an adjustable stock with the stock body removed from view in accordance with an embodiment of the present invention.
Figure 11:
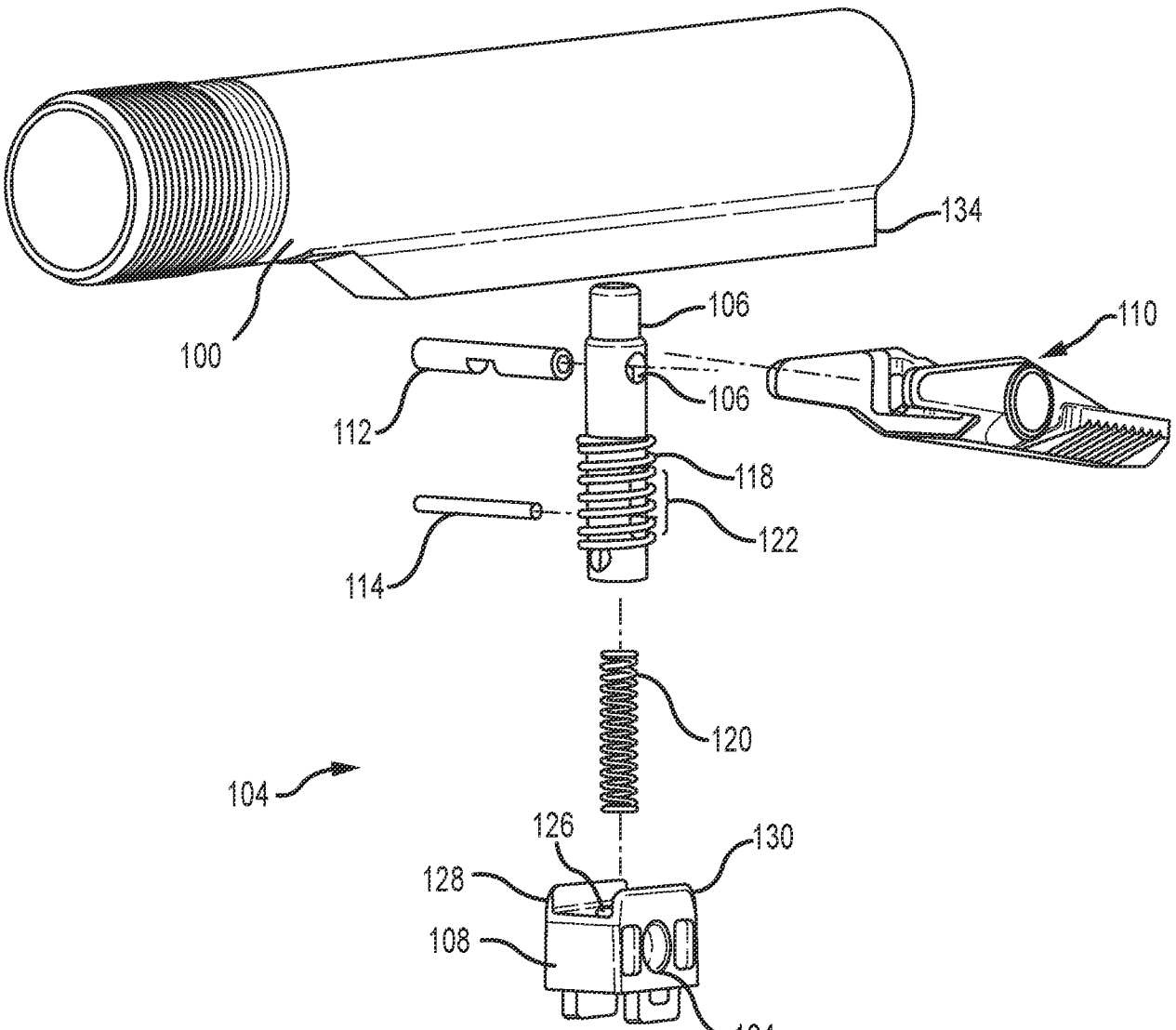
FIG. 11 is a perspective exploded view of an adjustable stock with the stock body removed from view in accordance with an embodiment of the present invention.

FIGS. 1 and 9-11 illustrate a perspective view of an adjustable stock having an embodiment of the independently sprung tensioning mechanism. FIGS. 9-11 remove the stock body from view to provide better visibility of the internals such as the tensioner block, the retaining pin, and the springs. The stock 102 couples to a buffer tube 100 and/or receiver extension (not shown) that can be fixed or removably coupled to a firearm receiver such as that of an M4 Carbine. The stock 102 includes a lever 110, a plug or cap 154, and the independently sprung tensioning mechanism 104 comprising a tensioning body 108, a first spring 118, a second spring 120, an indexing pin 106, a first retaining pin 112, a second retaining pin 114.

Figure 3:
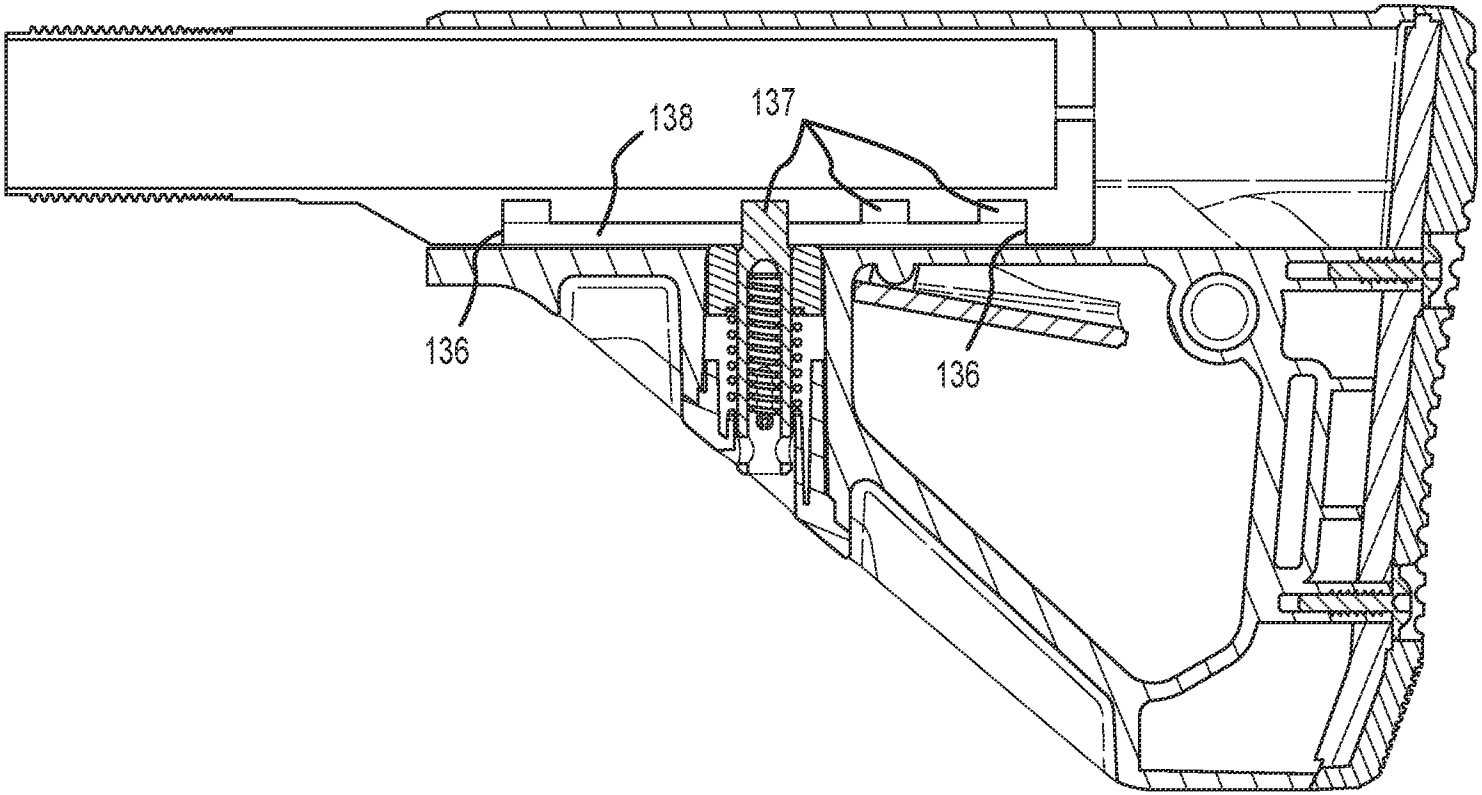
FIG. 3 is a sectional left side view of an adjustable stock in accordance with an embodiment of the present invention.

In some embodiments, the indexing pin 106 is an elongated structure, e.g., cylindrical, that is slidably arranged within an aperture 126 in the tensioner body 108 and is biased by the second spring 120 toward the buffer tube 100 and into an indexing hole (see 137 in FIG. 3) or channel 138 in a keyed extension 134 of the buffer tube 100. In some embodiments, the tensioner body 108 includes two fins 128 and 130 extending from a top left and right sides of the tensioner body 108 giving the tensioner body 108 a u-shaped profile when viewed along a longitudinal axis of the buffer tube 100 or firearm. In some embodiments, the tensioner mechanism (or tensioning block) maintains consistent upward pressure on the buffer tube and utilizes the U-shaped profile as a wedge onto the lower surfaces of the buffer tube keyway or keyed extension of the buffer tube. This arrangement creates an anti-rattle effect when installed onto a typical buffer tube.

In some embodiments, the tensioning body 108 is sprung independently from the indexing pin 106 which allows the tensioning block to move beyond the limited travel distance of the indexing pin 106 to take up slop that the indexing pin 106 cannot account for. More specifically, the tensioner body 108 wedges itself between the walls of the stock body 102 and the buffer tube 100 placing pressure onto the buffer tube 100 and taking up rotational tolerances in assembly. At the same time, the relatively square shape of the tensioning body 108 provides an increased surface area that comes into contact with the buffer tube 100 allowing for a more even distribution of pressure over a larger area than relying on the indexing pin 106 alone. The indexing pin 106 and tensioning body 108 move independently along the same vertical axis (perpendicular to a longitudinal axis of the buffer tube 100 and firearm), allowing each part to absorb tolerance discrepancies between interfacing components.

When adjusting the stock position on the buffer tube 100, the user activates the adjustment lever 110, which engages a retaining pin 112 to retract the indexing pin 106 from an indexing hole of the keyed extension 134. During the downward motion, the retaining pin 112 will also engage with and retract the tensioning body 108 so that both the indexing pin 106 and tensioning body 108 fully disengage from the buffer tube 100, taking the stock out of tension during adjustments. In other words, the tensioning body 108 and indexing pin 106 independently engage with the buffer tube 100 when moving to an engaged position (springs extending), but move in concert when disengaging from the buffer tube 100 (springs compressing).

In other embodiments, fins 128 and 130 are not present on tensioning body 108, while in others, fins 128 and 130 extend along each top side of tensioner body 108. In some embodiments, a distance between inner surfaces of these two fins 128 and 130 is substantially the same as a width of the keyed extension 134. In other words, the distance between inner surfaces of these two fins 128 and 130 is selected such that the fins 128 and 130 form a friction fit with outer sides of the keyed extension 134 when the tensioner body 108 is engaged with the keyed extension 134. In some embodiments, fins 128 and 130 form a tapered fit with outer sides of the keyed extension 134 when the tensioner body 108 is engaged with the keyed extension 134 to further reduce wobble between the stock 102 and the buffer tube 100. For example, as better seen in FIG. 13, in some embodiments, the fins 128 and 130 can be tapered and have a wider proximal portion 158 and a narrower distal end 156. As such, the spacing between the two proximal portions 158 of each side of tensioner body 108 is narrower than the spacing between each distal end portion 156. This allows the block to wedge onto the keyway of the buffer tube 100, and between the keyway and the inner surface of the stock 102, thereby removing more wobble than rectangularly-profiled fins would achieve. In addition, and/or alternatively, tight tolerances from the tensioner body 108 to the stock body 102 remove interplay from this interface. In some embodiments, the tensioner body 108 is configured to wedge into the stock body 102 at an end of upward travel. In other embodiments, there may be minimal clearance between the tensioner body 108 and the stock body 102 to reduce any wobble coming at the tensioner-to-stock interface. In many embodiments, a spacing between the fins 128 and 130 may change depending on elevation, for instance being narrower at the proximal region 158 and wider at the distal end 156. In some cases, a first width between the fins 128 and 130 at the proximal region 158 may be narrower than a width of the keyed extension 134, and a second width between the fins 128 and 130 at the distal ends 156 may be substantially equal to or wider than the width of the keyed extension 134. In some embodiments, the inside surfaces of the stock may be parallel or as shown in FIG. 13, in other embodiments, the inside surfaces of the stock may include a slight tapering similar to the outside surfaces of the fins 128 and 130.

In many embodiments, and as best seen in FIGS. 9 and 10, the tensioner body 108 is biased toward the buffer tube 100 by the first spring 118. More specifically, and with additional reference to FIGS. 6, 7 and 8, the first spring 118 is arranged around an outside of the indexing pin 106 and presses against a bottom of the tensioner body 108 or resides within a hollow 142 of the tensioner body 108, but pressing against a top, inside surface of the hollow 142. The first spring 118 includes a first end pressed against the bottom surface of the tensioning block 108 or the top, inner surface of the hollow 142 and a second end in contact with a top of or coupled to a second retaining pin 114. In many embodiments, the second retaining pin 114 passes through the indexing pin 106 perpendicular to a longitudinal axis through the firearm and buffer tube 100, and more specifically, through a first pair of elongated apertures 122 in a lower half of the indexing pin 106. The second retaining pin 114 also passes through the stock, for instance being at least partially received within two holes 150 in the stock, best seen in FIG. 1, and is thus stationary relative to the stock 102, but the indexing pin 106 and the tensioner body 108 move relative to the second retaining pin 114.

In many embodiments, second spring 120 is arranged inside of the indexing pin 106 and first spring 118 is arranged outside of the indexing pin 106. A first end of the second spring 120 engages with and/or abuts a portion of the first retaining pin 112 and a second end of the second spring 120 abuts a top portion of or is coupled to the second retaining pin 114. The first end of the first spring 118 applies a bias to the tensioner body 108 pushing it toward the buffer tube 100 and into engagement with the keyed extension 134. As aforementioned, second ends of both springs 118 and 120 interface with and/or abut the second retaining pin 114 and thus remain fixed relative to the stock 102 and the rest of the independently sprung tensioning mechanism 104. When the first spring 118 is fully extended, the tensioner block 108 is fully engaged with the keyed extension 134 and forms a friction fit engagement and/or wedging friction fit engagement with the buffer tube 100 that reduces wobble or tolerance discrepancies between the stock 102 and the buffer tube 100 (and hence reduces vibration). Where the fins 128 and 130 of the tensioner body 108 are tapered, the friction fit and/or wedging friction fit is further enhanced by a wedging of these fins into a gap between the stock 102 and the buffer tube 100.

In some embodiments, independent bias and operation of the indexing pin 106 and the tensioner block 108 means that the u-shaped tensioner block 108 can move upward around the keyed extension 134 (or wedge between the stock 102 and the buffer tube 100) to a greater extent than the indexing pin 106. In other words, without the independent movement and biasing, the indexing pin 106 might bottom out in one of the index holes 137 of the keyed extension 134 before the tensioner block 108 had fully engaged with (e.g., wedged) the keyed extension 134, or vice versa. Tolerances on the keyed extension 134 and/or channel 138 height, keyed extension 134 and/or channel width, and edge rounding can all lead to final preferred resting positions for the tensioner block 108 and the indexing pin 106. The independent biasing and movement of these components allows one to bottom out before the other thereby enabling both to maximize coupling with their respective portion of the buffer tube 100 and/or to accommodate tolerance differences between the stock and the buffer tube. Said another way, the independent movement and biasing of these two components means that wedging of the tensioning block 108 and engagement of the indexing pin 106 can take place independently, thereby accounting for these tolerance differences between the stock 102 and buffer tube 100 that a single/coupled/homogenous retaining mechanism would be unable to account for.

In many embodiments, and with reference again to FIGS. 9-11, the second retaining pin 114 is arranged within the first pair of elongated apertures 122 arranged along opposing sides of a bottom half of the indexing pin 106 such that the indexing pin 106 has a certain amount of freedom of movement independent from the bias on the tensioner block 108. More specifically, and in many embodiments, a first retaining pin 112 (or retaining pin) is arranged through a top half of the indexing pin 106 and also through a second pair of elongated apertures 124 in the tensioner block 108. In many embodiments, the second pair of elongated apertures 124 are not as long as the first pair of elongated apertures 122.

Figures 2A, 2B, 2C:
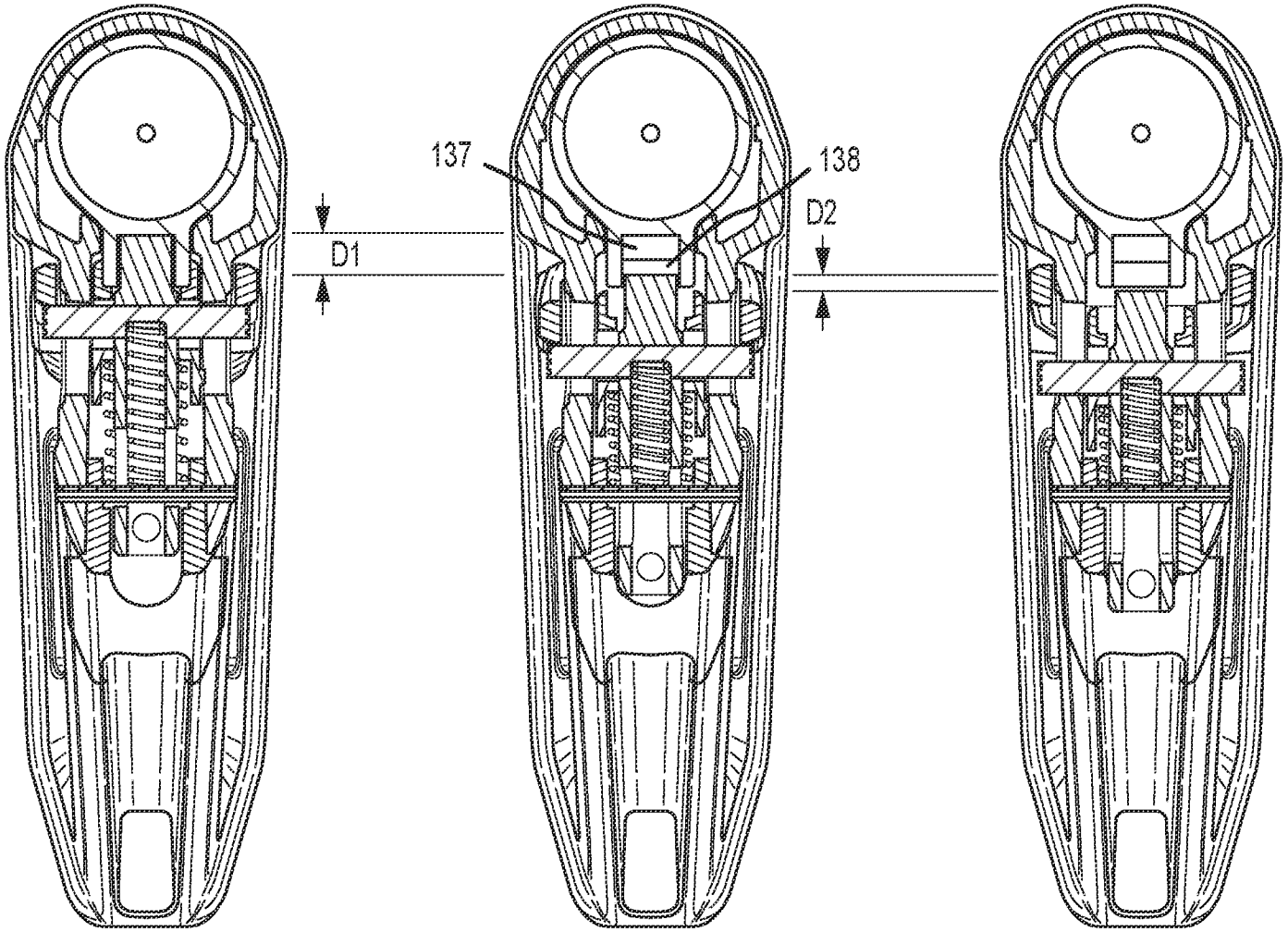
FIG. 2A is a sectional front view of an adjustable stock in accordance with an embodiment of the present invention.
FIG. 2B is a sectional front view of an adjustable stock in accordance with an embodiment of the present invention.
FIG. 2C is a sectional front view of an adjustable stock in accordance with an embodiment of the present invention.
Figure 5:
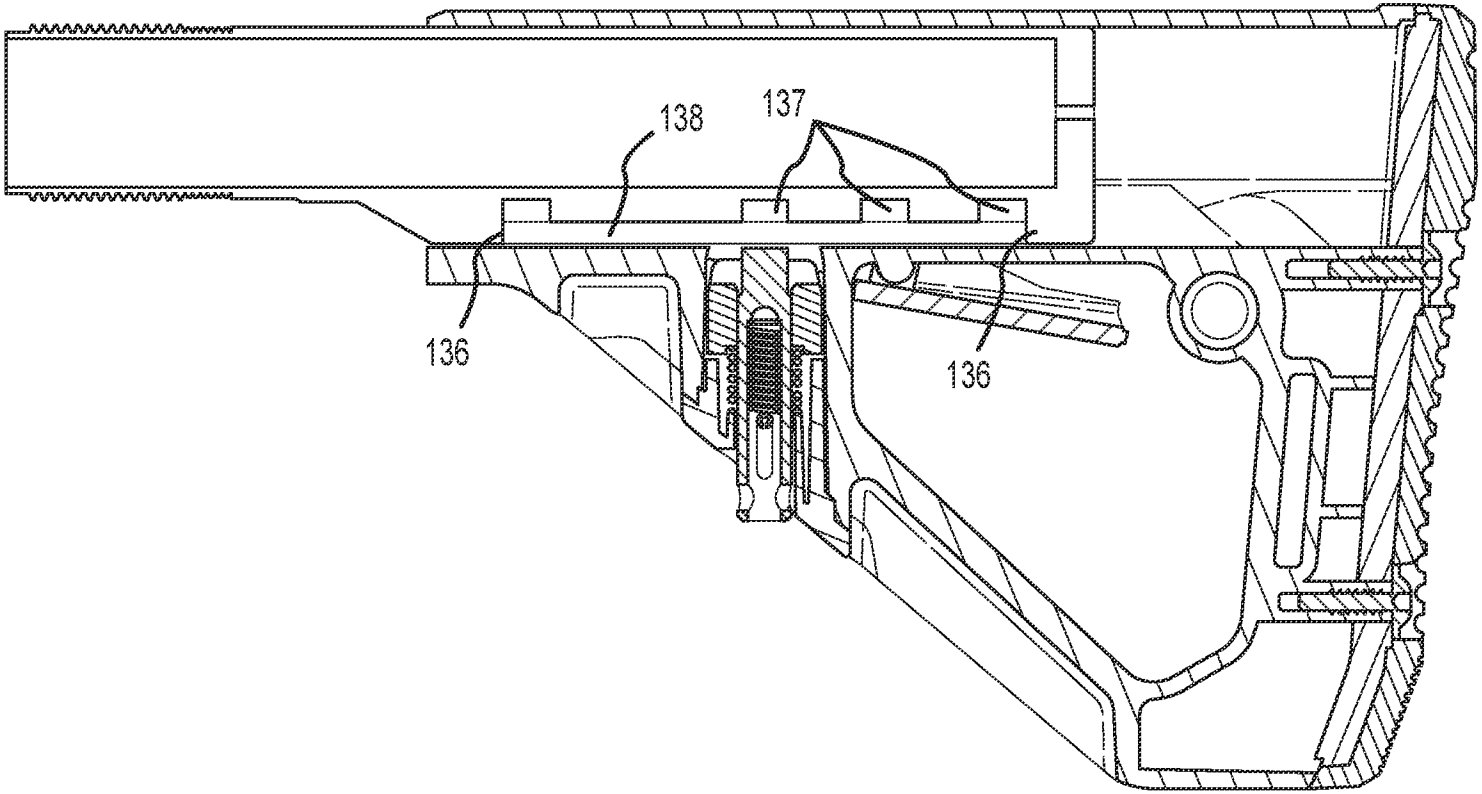
FIG. 5 is a sectional left side view of an adjustable stock in accordance with an embodiment of the present invention.
Figure 6:
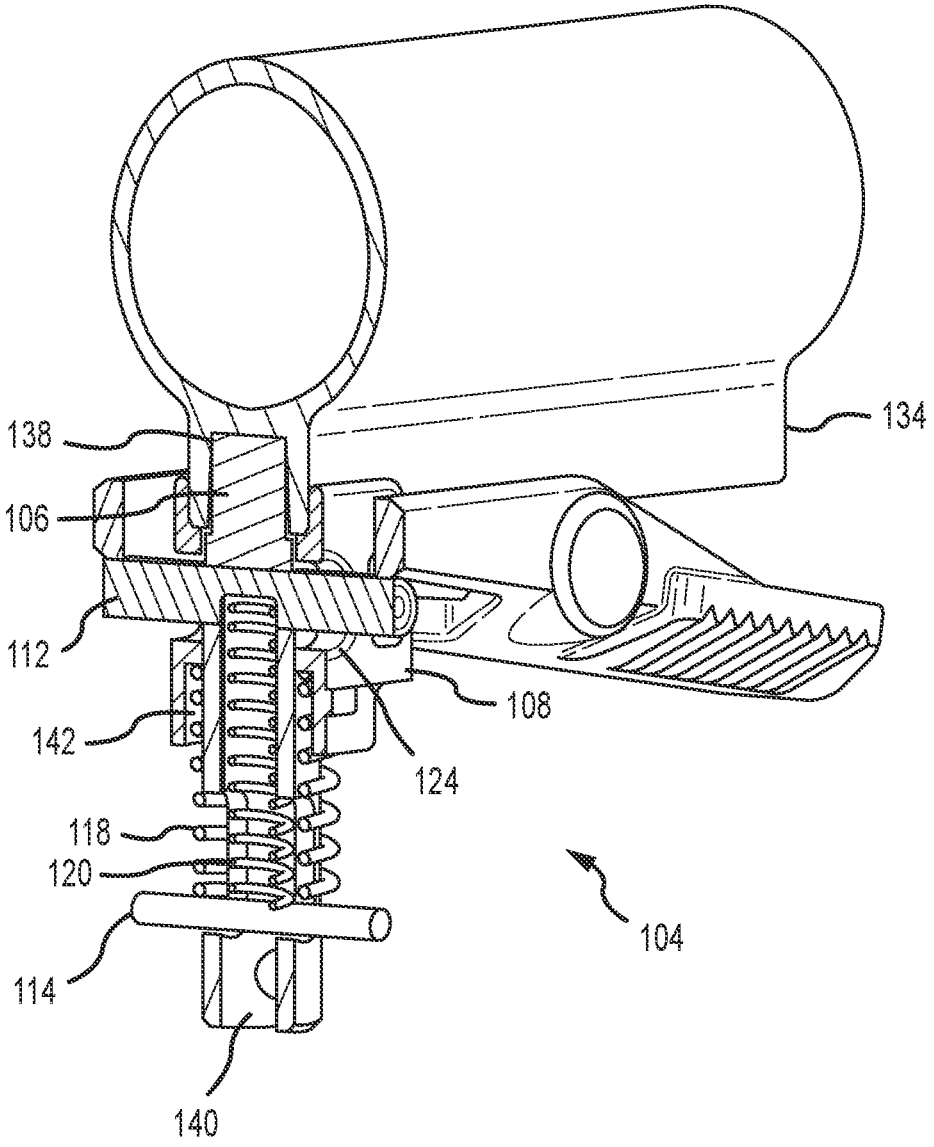
FIG. 6 is a sectional view of an adjustable stock with the stock body removed in accordance with an embodiment of the present invention.

In many embodiments, the lever 110 is arranged so that is either in contact with the first retaining pin 112 or is in the direct vicinity of retaining pin 112. As such, when the lever 110 is actuated, it first contacts the first retaining pin 112 (or may already be in contact with the first retaining pin 112) and thus immediately begins to move the first retaining pin 112, which starts in an engaged state and is arranged at a top of the second pair of elongated apertures 124, for instance, as seen in FIGS. 2A, 5 and 6. In the engaged state/position, both the indexing pin 106 and the tensioner block 108 are in contact with the buffer tube 100 and the stock 102.

Figure 4:
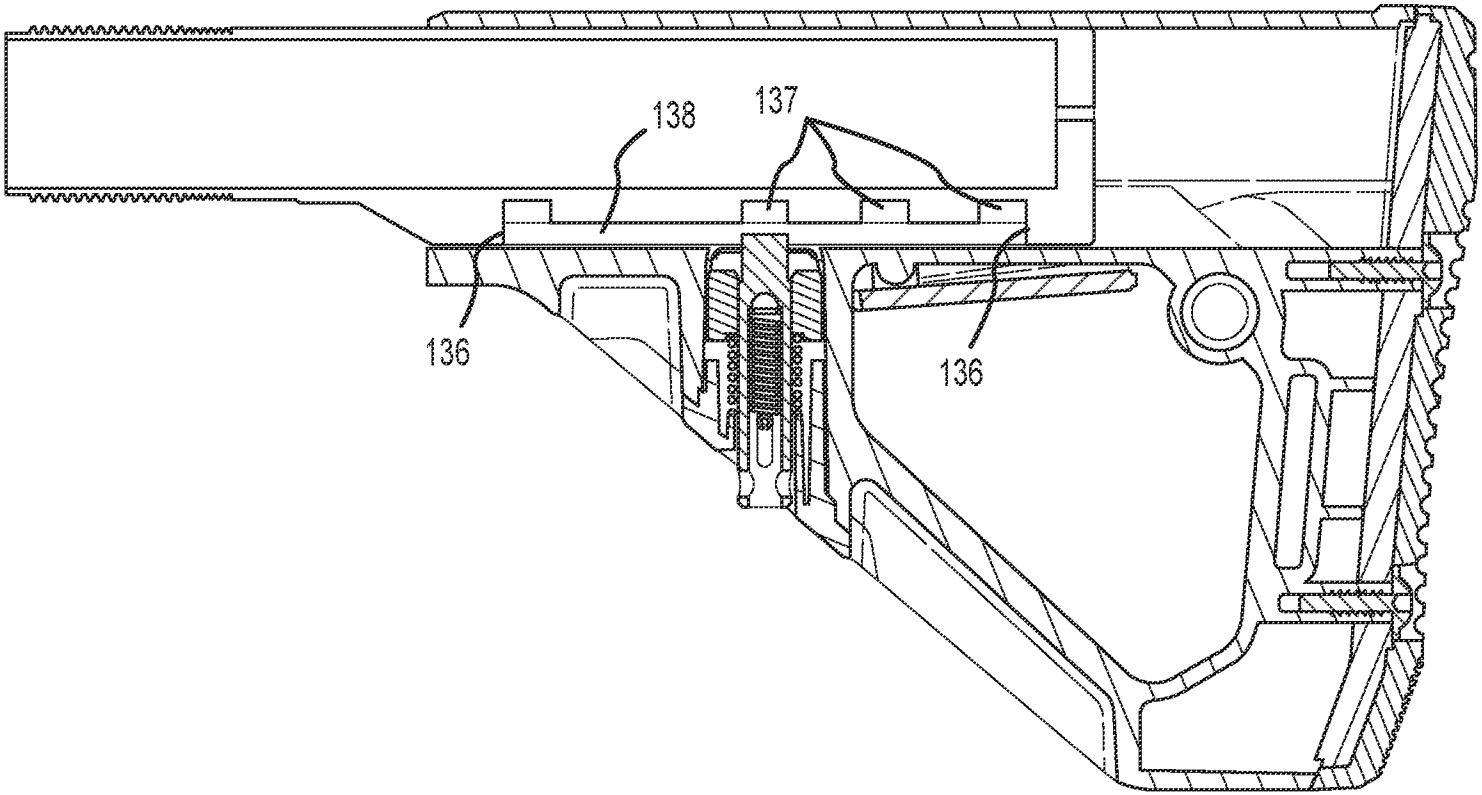
FIG. 4 is a sectional left side view of an adjustable stock in accordance with an embodiment of the present invention.
Figure 7:
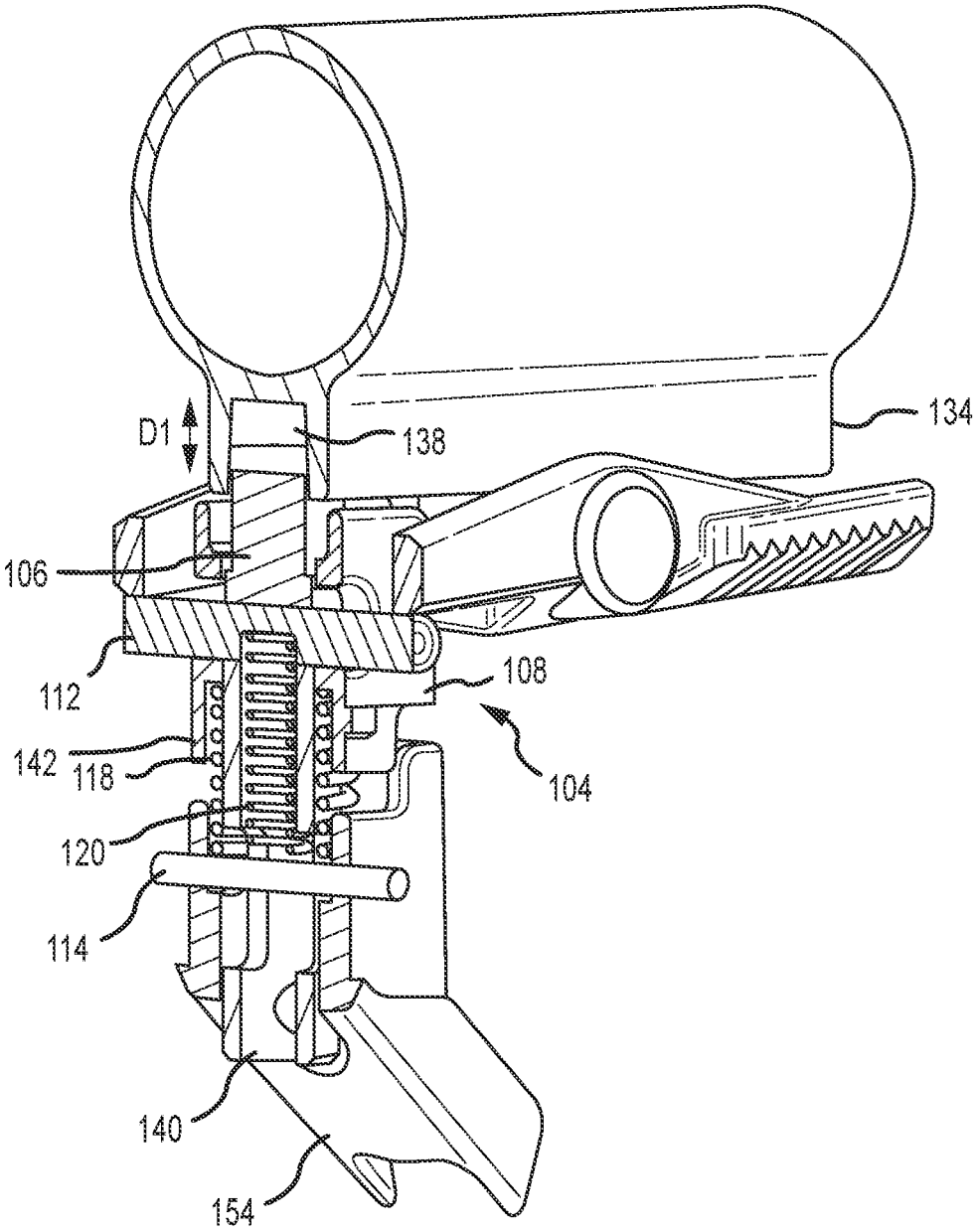
FIG. 7 is a sectional view of an adjustable stock with the stock body removed in accordance with an embodiment of the present invention.

With reference to an embodiment illustrated in FIGS. 2B, 4, and 7, the lever 110 pulls the first retaining pin 112 away from the buffer tube 100, which over a distance (D1), retracts the indexing pin 106 from one of the index holes 137 in the keyed extension 134, but leaves the indexing pin 106 at least partially within the channel 138. At the same time, this movement through distance D1 compresses the second spring 120 in the hollow 140 of the indexing pin 106, and at least through a first portion of distance D1, does not compress the first spring 118 or move the tensioner body 108. However, after some distance less than D1, the first retaining pin 112 contacts a bottom of the second pair of elongated apertures 124 in the tensioner block 108 as seen at FIGS. 2B, 4 and 7 and begins to pull both the indexing pin 106 and the tensioner block 108 away from the buffer tube 100.

Figure 8:
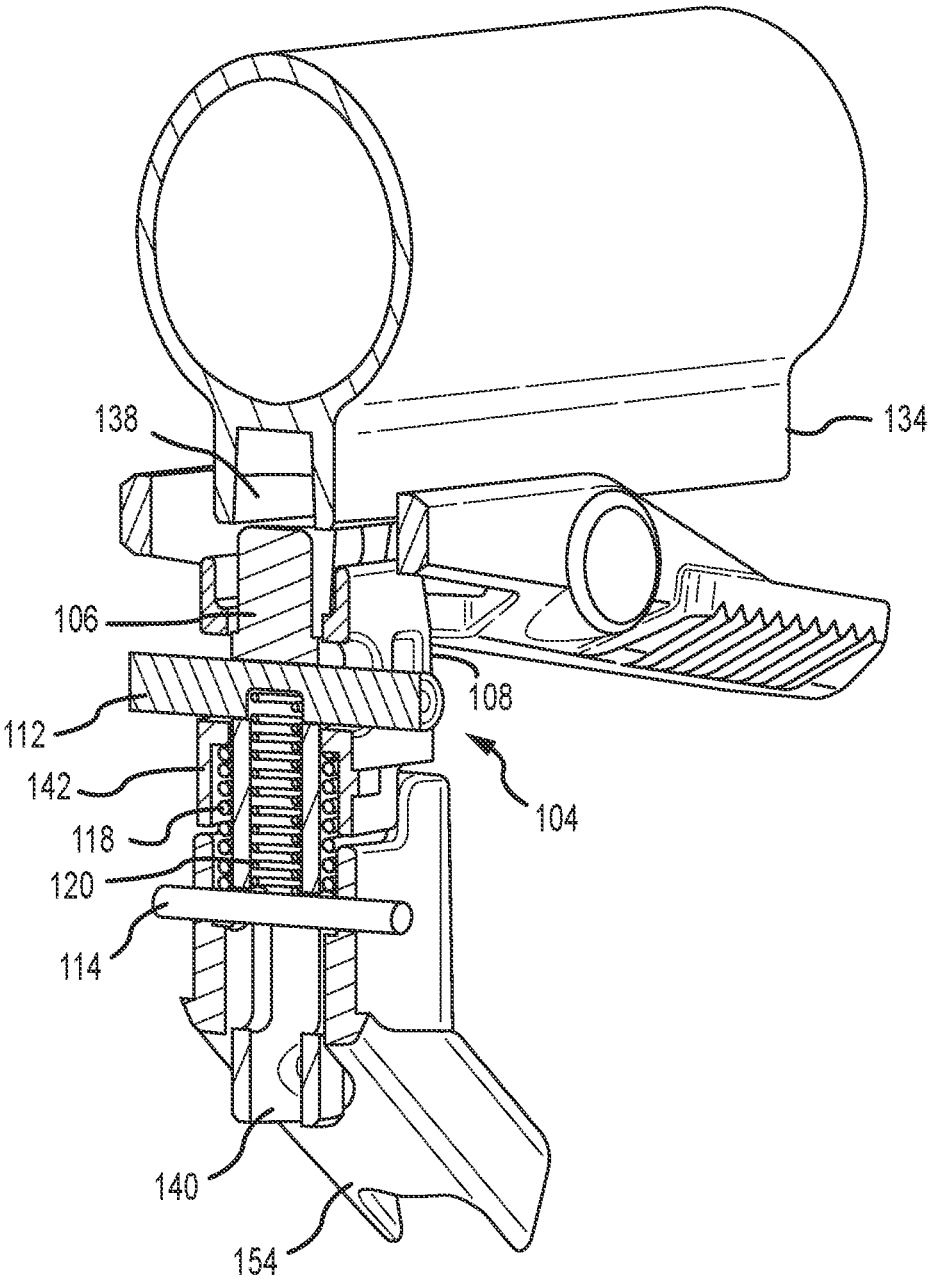
FIG. 8 is a sectional view of an adjustable stock with the stock body removed in accordance with an embodiment of the present invention.

Once the indexing pin 106 has cleared the index hole 137 that it was engaged with, the stock 102 is able to translate along the buffer tube 100 (adjustment to a new indexed position longitudinally along the buffer tube's axis). However, the stock 102 is prevented from being removed from the buffer tube 100 via the stops 136 (see FIG. 4), and thus the indexing pin 106 is able to traverse between the stops 136, but not beyond. Further retraction of the indexing pin 106 by D2 is needed to allow removal of the stock 102, as seen in FIGS. 2C, 5 and 8.

In some embodiments, while the lever 110 is used to move the indexing pin 106 the first distance D1, the lever 110 is not useful for moving the indexing pin 106 the further distance D2. Instead, a user directly forces the first retaining pin 112 away from the buffer tube 100 until the indexing pin 106 is able to clear the stops 136. In other words, to clear the stops 136 and remove the stock 102 from the buffer tube 100, a user presses down on the first retaining pin 112 such that the indexing pin 106 retracts a distance D1+D2 from the engaged or locked position. In some embodiments, the user can manually press or pull down on retaining pin 112. This is seen in FIGS. 2C, 5, and 8. In other words, the indexing pin 106 is no longer partially within the channel 138, can clear the stops 136, and the stock 102 can be removed from the buffer tube 100. In other embodiments, the lever 110 is configured to have two levels of movement, such that depressing lever 110 a first time or a first amount will retract the indexing pin 106 a distance D1 and depressing lever 110 a second time or a second amount will retract the indexing pin 106 a distance of D2, such that the indexing pin 106 will be retracted a total distance of D1+D2. As seen in FIG. 4, until the indexing pin 106 has been retracted to the point shown in FIGS. 2C, 5 and 8, the stock 102 cannot be removed from the buffer tube 100 due to the stops 136 at either end of the channel 138.

The engaged position of the indexing pin 106 can be best seen in FIGS. 2A, 3, 6, and 13 while the disengaged position is best seen in FIGS. 2C, 5, 8 and 9. In between these two positions, the length-of-pull adjustment position is best seen in FIGS. 2B, 4, and 7. In this position, the tensioner block 108 is disengaged from the keyed extension 134, and the indexing pin 106 is disengaged from the indexing holes 137, but is still partially within the channel 138 and thus cannot move beyond the stops 136 (i.e., the stock cannot be removed from the firearm).

In many embodiments, and with reference to FIGS. 3, 6, 7, 8 and 10, the first retaining pin 112 can include a flat or notch 113 in a bottom thereof that helps the first end of the second spring 120 to engage with the first retaining pin 112. Notch 113 also allows the spring to retain pin 112 laterally, locking it into the stock assembly. The bias from the second spring 120 is transferred to the indexing pin 106 through the first retaining pin 112, and in this way the indexing pin 106 is biased toward the buffer tube 100 and when aligned with one of the index holes 137 in the keyed extension 134 is biased into one of these index holes 137 to temporarily lock in a position of the stock 102. The first retaining pin 112 is arranged in an aperture 116 in the upper half of the indexing pin 106 to thereby transfer force from the lever 110 to the indexing pin 106. In some embodiments, the first retaining pin 112 could be homogenously formed with the indexing pin 106, such that they are a unitary structure, or be a form of an appendage from the indexing pin 106.

As seen in FIG. 1, the travel of the first retaining pin 112 is constrained within a third pair of elongated apertures 152 that are formed in sides of the stock 102. The top and bottom of the third pair of elongated apertures 152 acts as stops for movement of the indexing pin 106 via the first retaining pin 112.

Figure 12:
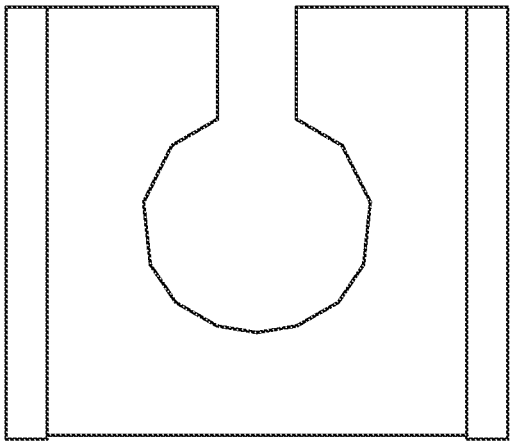
FIG. 12 is a top view of a portion of an adjustable stock in accordance with an embodiment of the present invention.

With reference to FIG. 10, although the aperture 126 in the tensioner block 108 is illustrated as being surrounded on all sides by the tensioner block 108, in other embodiments, a u-shaped tensioner block 108 could be implemented (as viewed from above). In other words, the aperture 126 could be replaced by a shape that cuts through one or more side of the tensioner block 108 when viewed from above. FIG. 12 illustrates just one non-limiting example of such a tensioner block as viewed from above where the aperture is combined with a channel through a 'front' or 'rear' end of the tensioner block (either of the sides that does not have a fin).

Figure 14:
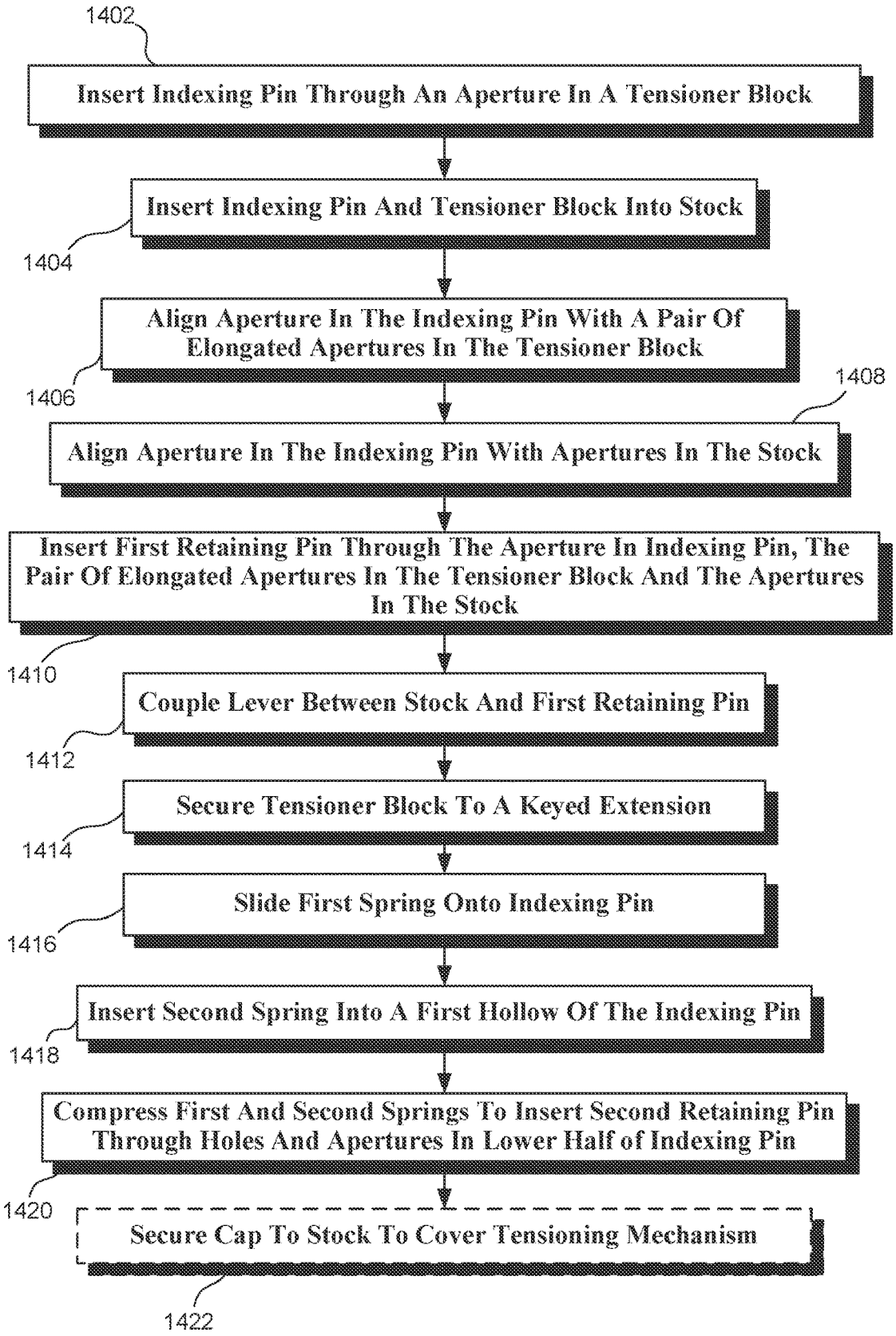
FIG. 14 is an illustration of a method for installing an independently sprung tensioning mechanism in an adjustable stock assembly in accordance with an embodiment of the present invention

Returning to FIGS. 1 and 10, and with additional reference to FIG. 14, a method 1400 is described for installing the independently sprung tensioning mechanism (e.g., 104) in an adjustable stock. An indexing pin (e.g., 106) can be inserted through an aperture (e.g., 126) in a tensioner block (e.g., 108), step 1402, and this pair can be inserted up into the adjustable stock (e.g., 102), step 1404. The aperture in the indexing pin can be aligned with a pair of elongated apertures in the tensioner block (e.g., 124), step 1406, as well as a pair of elongated apertures in the stock (e.g., 152), step 1408, and a first retaining pin (e.g., 112) can be inserted through the aperture in the indexing pin, the pair of elongated apertures in the tensioner block and the pair of elongated apertures in the stock, step 1410. In some embodiments, a lever (e.g., 110) can be coupled between the adjustable stock and the first retaining pin, step 1412, and the tensioner block can be secured to a keyed extension (e.g., 134), step 1414, by way of a friction fit and/or wedging friction fit. In this manner, a first end of lever 110 is movably secured between the keyed extension and the first retaining pin, such that when a second end of the lever is depressed, it causes tension to be transferred from lever 110 to the first retaining pin 112, and then movement of the retaining pin as described herein. A first spring (e.g., 118) can then be slid up the outside of the indexing pin to bottom out on a bottom of the tensioner block (or a hollow therein), step 1416, and a second spring (e.g., 120) can be inserted into a first hollow (e.g., 140) in the indexing pin, step 1418. Both springs can be compressed sufficiently to allow insertion of the second retaining pin (e.g., 114) through a pair of holes (e.g., 150) and a pair of elongated apertures in a lower half of the indexing pin, step 1420. A plug or cap (e.g., 154) can also be optionally secured to a bottom of an angled portion of the stock to cover and further secure the independently sprung tensioning mechanism in the stock, step 1420. Other orders of operation are also envisioned. For instance, the tensioner block can be secured to the keyed extension of the buffer tube (step 1414) after the second retaining pin has been inserted (step 1420).

As used herein, the recitation of "at least one of A, B and C" is intended to mean "either A, B, C or any combination of A, B and C." The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. An adjustable stock assembly for a firearm, comprising:

a stock body configured to couple to a buffer tube of the firearm;

a tensioning mechanism within the stock body, comprising:

a tensioning body configured to couple to the stock body;

an indexing pin slidably arranged within an aperture in the tensioning body and having a first spring coupled within the indexing pin;

a first retaining pin coupled through a first set of apertures in the indexing pin and coupled through two additional apertures within the tensioning body, and wherein a first end of the first spring abuts to a bottom portion of the first retaining pin; and a second retaining pin coupled through a second set of apertures in the indexing pin, wherein a second end of the first spring abuts to a top portion of the second retaining pin; and a second spring coupled around the indexing pin between the tensioning body and the second retaining pin.

2. The adjustable stock assembly of claim 1, wherein the tensioning body has two fins extending from a top side of the tensioning body, thereby providing a u-shaped profile to the tensioning body.

3. The adjustable stock assembly of claim 2, wherein the two fins of the tensioning body are tapered.

4. The adjustable stock assembly of claim 2, wherein the two fins form a wedging friction fit engagement with a keyed extension of the buffer tube.

5. The adjustable stock assembly of claim 1, wherein the first retaining pin is actuated by a lever to retract the indexing pin from engagement with the buffer tube.

6. The adjustable stock assembly of claim 1, further comprising one or more stops within the buffer tube limiting movement of the indexing pin.

7. The adjustable stock assembly of claim 1, wherein the tensioning body and the indexing pin can move independently to accommodate tolerance differences between the stock body and the buffer tube.

8. A method for installing an independently sprung tensioning mechanism in an adjustable stock assembly, comprising:

inserting an indexing pin through a first aperture in a tensioning body;

aligning a first pair of apertures in the indexing pin with a second pair of apertures in the tensioning body;

inserting a first retaining pin through the first and second pairs of apertures;

sliding a first spring into the indexing pin, wherein a first end of the first spring abuts against the first retaining pin;

inserting a second spring into a hollow in the tensioning body and around a portion of the indexing pin; and compressing both springs to allow insertion of a second retaining pin through a second pair of apertures in the indexing pin.

9. The method of claim 8, further comprising coupling a first end of a lever between the first retaining pin and a keyed extension of a buffer tube by a friction fit.

10. The method of claim 8, further comprising coupling the tensioning body to a keyed extension of a buffer tube.

11. The method of claim 8, further comprising securing a cap to a bottom of an angled portion of a stock body to cover the independently sprung tensioning mechanism.

* * * * *